United States Patent [19]

Schlosberg et al.

[11] 4,072,475

[45] Feb. 7, 1978

[54] METHOD FOR IMPROVING GASIFICATION PROCESS RATES AND YIELDS BY MEANS OF ELECTROPHILIC AROMATIC SUBSTITUTION PRETREATMENT OF COAL

[75] Inventors: Richard H. Schlosberg, New Providence; Franklin J. Wright, Plainfield; Ronald L. Hartgerink, Edison, all of N.J.

[73] Assignee: Exxon Research & Engineering Co., Linden, N.J.

[21] Appl. No.: 720,144

[22] Filed: Sept. 3, 1976

[51] Int. Cl.[2] ..... C10J 3/00

[52] U.S. Cl. ..... 48/210; 44/1 R; 48/202

[58] Field of Search ..... 48/210, 202, 206, 197 R, 48/214 A; 44/1 R; 208/8

[56] References Cited

U.S. PATENT DOCUMENTS

| | | | |
|---|---|---|---|
| 3,888,043 | 6/1975 | Child et al. | 48/210 |
| 3,920,418 | 11/1975 | Rice | 48/210 |
| 3,940,190 | 2/1976 | Hayes | 48/214 A |
| 3,970,541 | 7/1976 | Williams et al. | 48/210 |
| 3,996,026 | 12/1976 | Cole | 48/202 |

*Primary Examiner*—Robert L. Lindsay, Jr.
*Assistant Examiner*—George C. Yeung
*Attorney, Agent, or Firm*—Joseph J. Allocca

[57] ABSTRACT

Coal is electrophilically aromatically substituted (i.e., alkylated or acylated) in the presence of an alkylating or acylating agent with or without a catalyst under mild conditions to give a treated coal product. This treated coal product may then be solvent extracted to give an extract and an upgraded coal residue, with this residue being subjected to a gasification process procedure or the treated coal product may be subjected to gasification process procedures without any prior extraction being performed. By means of either technique, a material is prepared for which the rate of gasification and the yield of desired product upon gasification is dramatically increased when compared with nonelectrophilically aromatically substituted material (i.e., raw coal). An improved gasification process is disclosed comprising the steps of electrophilically aromatically substituting coal and subjecting such pretreated coal, either extracted or unextracted to gasification process techniques.

26 Claims, 2 Drawing Figures

Figure I
REACTIVITY OF ALKYLATED COAL
RATE OF REACTION WITH $CO_2$ AT 850°C
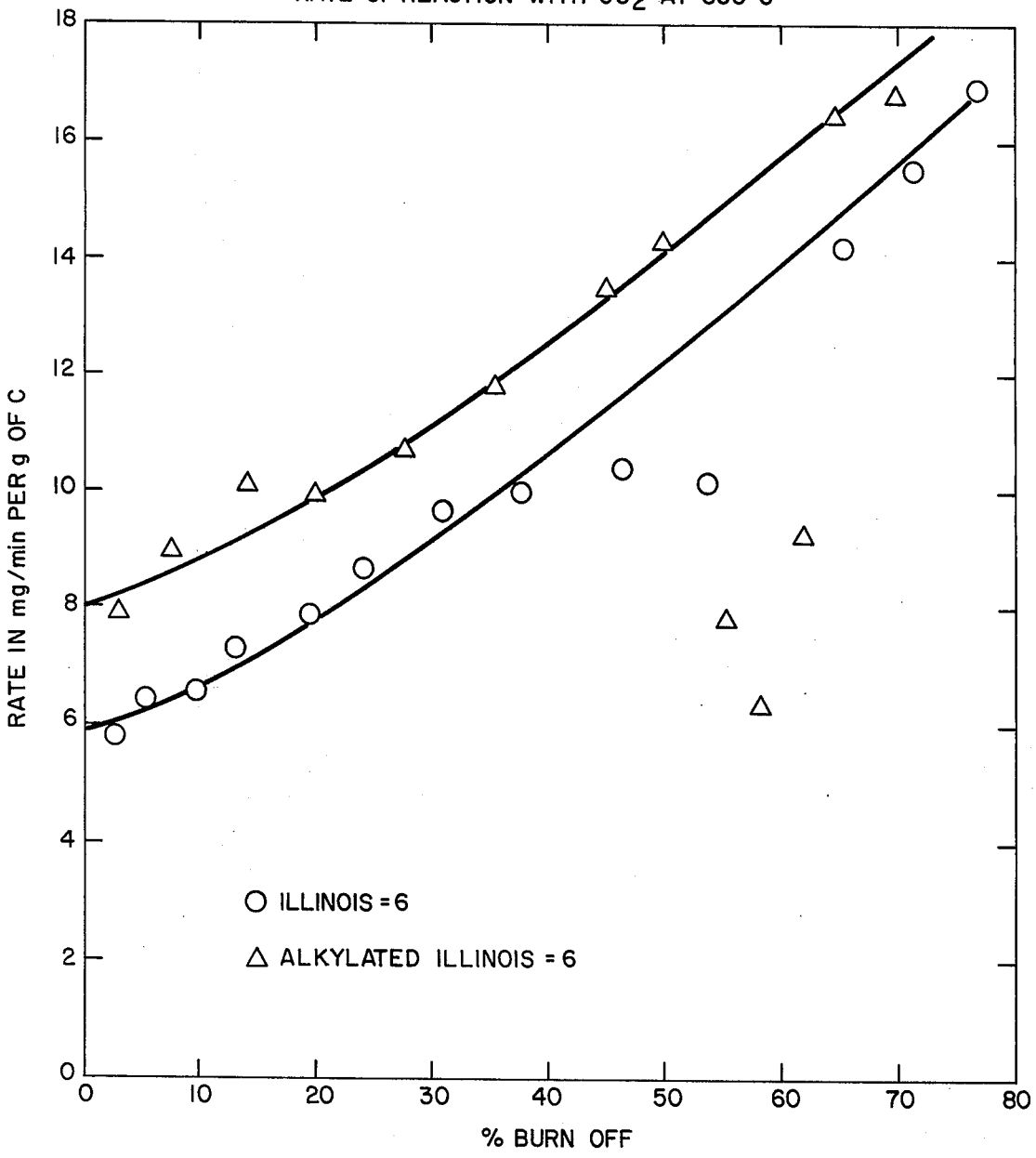

Figure II
ALKYLATED WYODAK
$CO_2$ AT 850°C
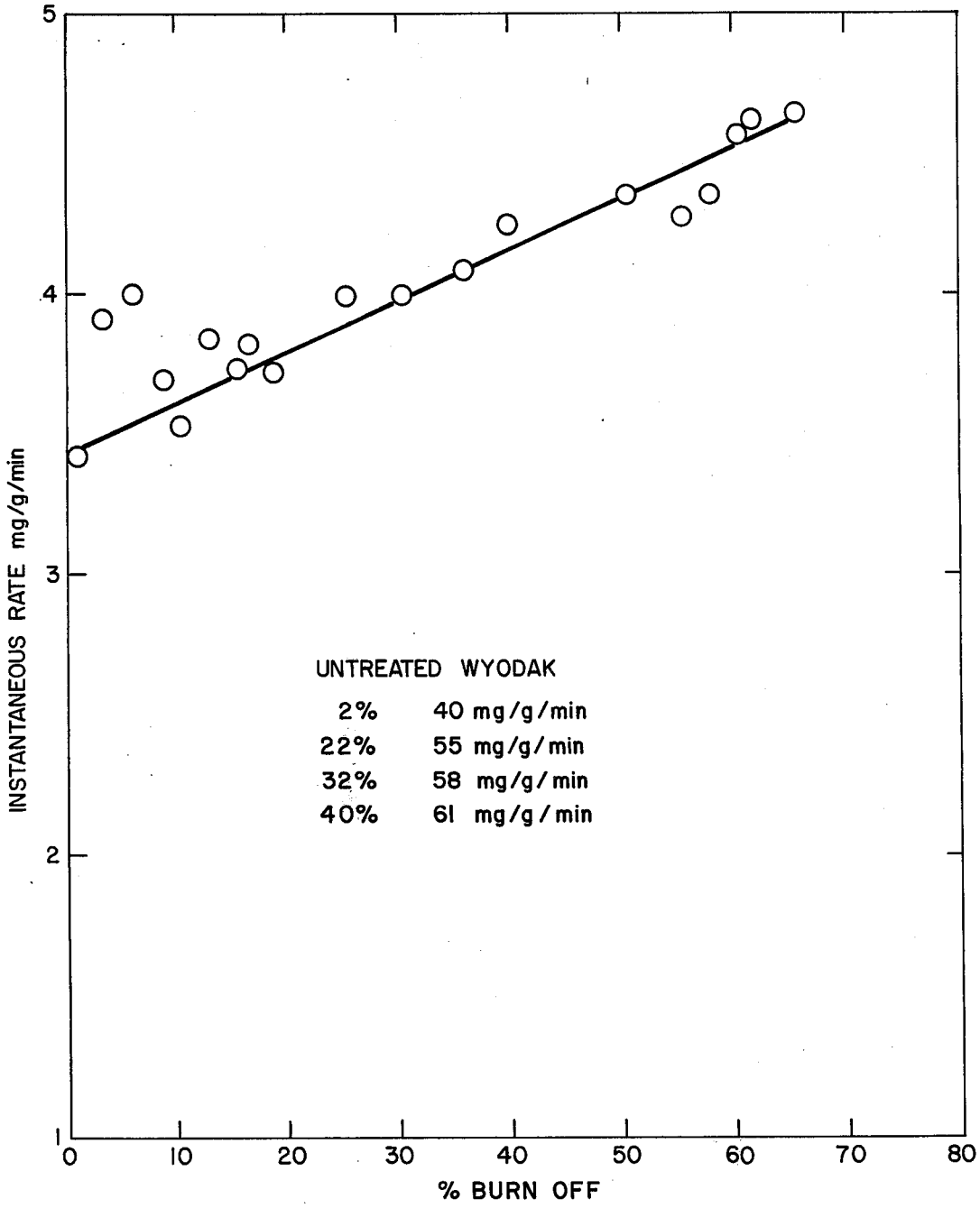

METHOD FOR IMPROVING GASIFICATION PROCESS RATES AND YIELDS BY MEANS OF ELECTROPHILIC AROMATIC SUBSTITUTION PRETREATMENT OF COAL

Much of the world's needs for liquid fuels are and will continue to be supplied by crude oil production, but this supply cannot meet the added growth indefinitely. In the last 20 years of this century, the needs for clean automotive, aviation, residential, and commercial liquid fuels will exceed the availability of such fuels from conventional sources. Large deposits of coal are available to help fill the gap and could be converted to clean liquids as commercial technology emerges. It appears that one of the preferred ways to use coal in industry and electric power generation while meeting acceptable environmental standards will be coal conversion to clean liquid fuels. Thus, coal conversion processes will be important factors in meeting the world's energy needs for the remainder of this century.

COMPOSITION OF COAL

Chemically, coal has a much lower ratio of hydrogen to carbon than natural petroleum and contains larger amounts of impurities as illustrated in Table I.

TABLE I

Elemental Composition of Some Coals and Hydrocarbons (1)

| | Form | Wt % of Element in Fuel C | H | O | S | N | Other |
|---|---|---|---|---|---|---|---|
| Methane ($CH_4$) | Gas | 75 | 25 | — | — | — | — |
| Naphtha | Liq. | 85 | 15 | — | — | — | — |
| Fuel Oil | Liq. | 86 | 12 | 0.5 | 0.4 | 0.5 | 0.6 |
| Bituminous Coal (Dry) | Solid | 73 | 5 | 9.0 | 3.0 | 1.5 | 8.5 |
| Subbit. Coal (Dry) | Solid | 71 | 5 | 16.0 | 0.5 | 1.5 | 6.0 |
| Lignite (Dry) | Solid | 64 | 4.6 | 18.0 | 0.5 | 1.5 | 11.4 |

(1) Federal Power Commission, "Synthetic Gas-Coal", prepared by the Synthetic Gas-Coal Task Force for the Supply-Technical Advisory Committee of the National Gas Survey, Issued April, 1973.

While the structure of coal is not completely understood, over 70% of the carbon atoms are thought to be in aromatic rings. It is generally believed that much of the carbon is present in condensed ring structures such as pyrene or phenanthrene.

Numerous authors have proposed molecular structures for coals, exemplified by Given's picture of a typical (Vitrain of 82% C) bituminous-type coal. The key features of the Given model include a 9,10-dihydrophenanthrene prototype, a minimum of alkyl side chains, a non-planar structure, and a value of 70% for the aromatic carbons versus 30% aliphatic carbons. The empirical formula for the Given model is $C_{102}H_{77}O_{10}N_2$.

It is possible, however, to state that coal contains aromatic rings which are highly substituted (i.e., fused to other aromatics, fused to hydroaromatics, or attached to alkyl, ether, hydroxyl, etc. groups.) Furthermore, it is believed that analogously to proteins, coal exhibits secondary structural characteristics. Thus there seem to be hydrogen bonds, interaromatic ring bonds, etc., which generate the three dimensional structure of coal.

PRIOR ART

There are three general schemes used to derive liquid and gaseous products from coal. The simplest approach is pyrolysis. Heat is used to drive off or "distill" the volatile portions of the coal without adding hydrogen. This results in substantial quantities of by-product char.

A second scheme involves both heat and the addition of H under pressure. This is the approach usually described as coal liquefaction. Volatile matter is driven off and portions of the coal molecule are broken down. Hydrogen is added by chemical reaction with some of the coal to form hydrocarbons with molecular weights lower than the original coal moieties.

A third scheme is conversion of the coal to gaseous products, e.g. hydrogen and carbon oxides, through very high temperature processing. Subsequently, this gas mixture may be reacted catalytically to form hydrocarbons. This approach incorporates coal gasification with steam and oxygen followed by the Fischer-Tropsch synthesis reaction or other analogous processes to produce the liquid or gaseous (e.g. methane, ethane) hydrocarbons.

Gasification involves reacting coal with steam or another convenient small molecule such as $CO_2$, etc., at 1500° F. and above, (catalytically at 1200° F) and at pressures of up to 1500 psi. This makes a mixture of methane, hydrogen, and carbon oxides. In upgrading steps, this mixture is converted to hydrogen or to synthetic natural gas (SNG). The upgrading steps are based on commercial technology and are essentially the same in the various processes. Differences in approach mainly concern the gasification reactor configuration and method of heat input.

Some processes can make either high Btu SNG or 150–500 Btu/SCF gas which is preferred economically in some cases.

Another option involves gasification by partial oxidation, i.e., reaction of coal with oxygen (or air) instead of with steam. The Koppers-Totzek partial oxidation process is developed and commercially available.

Raw gas upgrading to high Btu gas is common to all gasification processes. The raw gas ($CO + H_2$) produced in the gasification reactions must thus undergo shift ($CO + H_2O \rightarrow CO_2 + H_2$), acid gas removal ($CO_2$ and $H_2S$) and methanation ($CO + 3H_2 \rightarrow CH_4 + H_2O$) to produce high-Btu or pipeline quality gas. Moreover, the same basic chemical reactions are involved in gasification reactions, to wit:

$$\left.\begin{array}{l} \text{Coal} + H_2 \longrightarrow CH_4 + C \\ C + H_2 \longrightarrow CH_4 \end{array}\right\} \text{Hydrogasification}$$

$$C + H_2O \longrightarrow CO + H_2 \quad \text{Steam Gasification}$$

$$C + O_2 \longrightarrow CO_2 \quad \text{Provides heat for process}$$

$$2\,CO \longrightarrow CO_2 + C \quad \text{Boudouard Run}$$

Some methane is therefore formed directly from coal and some by carbon-hydrogen interaction. Carbon also reacts with steam and some of the coal is burned to provide heat for the gasification.

BRIEF DESCRIPTION OF THE DRAWINGS

FIG. I presents the reactivity of alkylated coal as compared to the reactivity of unalkylated coal based on the rate of reaction with $CO_2$ at 850° C.

FIG. II presents the instantaneous rate in mg/g/min against % burn off of alkylated Wyodak coal subjected to $CO_2$ at 850° C.

PRESENT INVENTION

It is an object of the instant invention to produce an upgraded coal for use in coal processes which features greater product yields with reduced waste generation.

It is another object of the instant invention to demonstrate a multistep process for upgrading coal and utilizing the coal, thereby obtaining increased yields of useful products.

The instant invention teaches a multistep process for the production of synthetic fuels. Briefly, the process involves the alkylation or acylation of coal to produce an upgraded product which product in its turn is subjected to coal gasification process conditions to yield desirable synthetic fuel precursors and products. It has been unexpectedly discovered that pretreatment of coal via alkylation or acylation yields a product which, when subjected to coal gasification conditions displays enhanced activity as compared to raw coal. It has also been surprisingly discovered that using alkylated or acylated coal as starting material in coal gasification reactions permits such processes to give equivalent or even higher yields of desired product vis-a-vis raw coal; or similar yields at less severe reaction conditions. It has also been surprisingly discovered that alkylated or acylated higher rank coals show superior gasification product yields than do alkylated or acylated low rank (i.e. sub-bituminous) coals. Further, the rate of gasification of the upgraded material is markedly improved in addition to exhibiting superior weight loss characteristics upon slow pyrolysis (i.e. greatly enhanced product yield upon slow pyrolysis). The coals which may be utilized in electrophilic aromatic substitution reaction (i.e. alkylation or acylation) to give a product with enhanced gasification characteristics are higher rank coals, i.e. anthracite, and bituminous as exemplified by Illinois #6 and Kentucky HVB coals.

This invention relates to a method whereby coal is pretreated via electrophilic aromatic substitution reactions to yield an upgraded product which product is then utilized is gasification process procedures and is marked by improved yield and rate characteristics in such procedures.

The upgraded product may be used either extracted with a solvent before gasification or used directly in such gasification processes without extraction.

Two typical electrophilic aromatic substitution reactions are alkylation and acylation. Imposition of big alkyl or acyl groups into the coal structure presumably disrupts the secondary structural features, e.g. hydrogen bonds, interaromatic ring bonds, etc., of coal.

Literature on coal pretreatment and especially alkylation is relatively meager. What work has been done has generally been conducted with the overriding purpose of increasing the solubility of the coal in various solvents so as to facilitate the gathering of analytical data which can lead to a better understanding of coal structure and chemical makeup.

Such work was conducted by Frank Meyer and presented in his doctoral thesis "Reaktionen von Steinkohlen und Modellsubstanzen im System Fluorwasserstoff-Bortrifluorid" at the University of Munich, 1969.

In the course of his study, Meyer conducted what he characterized as depolymerization of coals by means of Friedel-Crafts catalysis, the classic method used for alkylation. Meyer demonstrated how, by Friedel-Crafts alkylation, the solubility of coals in various solvents can be increased. The acid catalyst system he employed was $HF-BF_3$ while the alkylating agents were generally alkenes containing two to twenty carbon atoms. Solubility in pyridine, chloroform and benzene exhibited a tendency to increase with increasing size of the alkyl group. Analysis conducted to determine the hydrogen to carbon ratio in the alkylated coal material disclosed that the hydrogen/carbon (H/C) ratio went from 0.674 with untreated coal to 0.828 for $C_{12}$ 1-dodecene alkylated coal to 1.15 for 1-eicosene alkylated coal.

After extraction, hard coal, which normally had a pyridine soluble constituent having a H/C ratio of 0.622 demonstrated that such pyridine soluble constituent rose to an H/C of 0.937 when the coal was alkylated with 1-dodecene and rose to 1.25 when 1-eicosene was used.

However, analysis of the residue remaining after extraction of the alkylated material demonstrated a marked reduction in the H/C ratio. That portion of untreated coal which is insoluble in pyridine had a H/C (atomic) of 0.560. When 1-dodecene was used the H/C ratio went to 0.555. Resort to 1-eicosene yielded a pyridine insoluble residue which had H/C of 0.555. The work of Meyer therefore tends to demonstrate that alkylation of coal yields a product which exhibits improved solubility in a variety of solvents, which has a pyridine soluble constituent having markedly improved H/C ratio but which produces a residue decidedly inferior in H to C ratio which would lead one to the conclusion that coal alkylation followed by extraction results in the production of a degraded residue possessing inferior characteristics when compared to normal raw coal.

Werner Hodek and George Kölling in *Fuel,* 1973, Vol. 52, "Increase in Extractability of Bituminous Coals Caused by Friedel-Crafts Acylation" examined the effect of acylation on coal chemistry. Again, these experiments were undertaken with an eye toward clarifying and expanding current understanding of the structure of coal. Hodek and Kölling indicate that other researchers reacted coal with $BF_3$ and phenol (Heredy and Neuworth) so as to improve extractability in various solvents. Hodek and Kölling, in the course of their work determined the extractability of coals in pyridine both before and after treatment with acylating agents in the presence of aluminum chloride. They used, as acylating agents, the chlorides of acetic acid, propionic acid, butyric acid, isoovaleric acid, caproic acid, sebacic acid ($C_7$), caprylic acid ($C_8$), capric acid ($C_{10}$) stearic acid ($C_{12}$), palmitic acid ($C_{16}$) and determined that acylation increased the extractability in pyridine of all but low rank coals.

THE ELECTROPHILIC AROMATIC SUBSTITUTION STEP OF THE INVENTION

Alkylation and acylation can be broadly characterized as electrophilic substitution reactions. More particularly, the alkylation or acylation of coal can be characterized as an electrophilic substitution wherein the aromatic carbon-hydrogen bond, e.g., aromatic C—H of the coal molecule, is the site of primary attack by the alkylating or acylating agent.

Alkylation and acylation are well known and well documented reactions. The use of coal as the material to be alkylated or acylated does not change the chemistry of the reaction or the manner in which the reaction proceeds. Consequently, coal can be alkylated or acylated at conditions amenable to alkylation or acylation of many other materials, particularly those of an aromatic nature. Nevertheless, the coal should be in a finely ground state, further elaborated upon hereinbelow, to facilitate contact with the alkylating or acylating reagent which may be either a liquid or a gas at reaction conditions. Generally, any compound capable of being an acylating agent or an alkylating agent can be employed.

In the case of acylation, the reagent may be any compound containing an acyl group, that is,

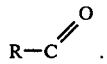

Thus, acyl halides, e.g., iodide, bromide, chloride, or fluoride, can be employed as well as haloacyls, e.g., phosgene, and compounds generally of the formula

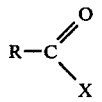

wherein X may be a halogen (i.e., iodine, bromine, chlorine, fluorine),

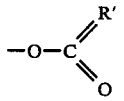

(as in anhydride), and R may be alkyl, cycloalkyl, aryl cycloalkyl, or arylalkyl. Acylation also includes the reaction of CO in the presence of a Friedel-Crafts catalyst to synthesize aldehydes, i.e., formylation. By this method CO is introduced into aromatic molecules under the influence of typical Friedel-Crafts catalysts. The number of carbon atoms in the acyl containing compound can vary widely, such as $C_2$ or larger, preferably $C_2$ to $C_{20}$. Examples of acyl containing compounds are acetyl chloride, lauroyl chloride, benzoyl chloride, etc. Additionally, carbon monoxide, although not an acyl compound, per se, can be employed, as previously mentioned, in the formylation reaction.

In the case of alkylation, the reagent can be olefinic, paraffinic, cycloparaffinic, or an alkyl halide. The size of the reagent is not critical although the larger the chain the greater the benefit per reaction site insofar as subsequent conversion of the coal via gasification is concerned. Preferably $C_2$–$C_{20}$ olefins are employed, $C_2$–$C_{20}$ paraffins, and compounds having the general formula $R_2$—X wherein X is any halogen and $R_2$ can be alkyl, cycloalkyl, aryl cycloalkyl, or arylalkyl and more preferably having from 1–20 carbon atoms. Still more preferably are $C_2$–$C_8$ alkyl halides and $C_2$–$C_8$ olefins, e.g., ethylene, propylene, butylene, pentylene, butyl chloride, propyl bromide, ethyl chloride, ethyl iodide, etc.

Alcohols can also be employed as alkylating agents although a greater than stoichiometric amount of catalyst is usually required when an alcohol is the alkylating reagent. $C_1$–$C_{20}$ straight chain or branched compounds can be employed. Thus, in the formula $R_2$—X, X can also be an OH (hydroxyl) group.

The use of acyl halides or alkyl halides requires the use of an acid catalyst to promote the desired reaction. Catalysts that can be employed are broadly characterized as electron acceptors and may be commonly referred to as Friedel-Crafts catalysts. Examples of such catalysts are as follows. (1) Acidic halides such as Lewis acids, typified by metal halides of the formula $MX_n$ wherein M is metal selected from Groups IIB,IIIA,IIIb-,IVA,IVB,VA,VB,VIB,or VIII of the Periodic Chart of the Elements, X is a halide from Group VIIA, and $n$ is an integer from 2 to 6. Further examples of these materials are the fluorides, chlorides, or bromides, preferably fluorides, chlorides, or bromides of aluminum, beryllium, cadmium, zinc, boron, gallium, titanium, zirconium, tin, lead, bismuth, iron, uranium, molybdenum, tungsten, tantalum, niobium, etc. Preferably, preferred materials are aluminum chloride, aluminum bromide, zinc chloride, ferric chloride, antimony pentafluoride, tantalum pentafluoride, boron trifluoride, etc. Additionally, these materials may be promoted with cocatalysts that are proton releasing substances, e.g., hydrogen halides, such as hydrogen chloride. Thus, a particularly preferred catalyst is HCl or $AlCl_3$/HCl. (2) Metal alkyls and halides of aluminum, boron, or zinc, e.g., triethyl aluminum, diethyl aluminum halide, and the like. (3) Protonic acids commonly referred to as Bronsted acids and typified by sulfuric acid, hydrofluoric acid, hydrochloric acid, hydrobromic acid, fluorosulfuric acid, phosphoric acid, alkane sulfonic acids, e.g., trimethane sulfonic acid, trifluoroacetic acid, aromatic sulfonic acids such as para-toluene sulfonic acid, and the like, preferably HF or HCl. (4) Acidic oxides and sulfides (acidic chalcides) and modified zeolites, e.g., $SiO_2/Al_2O_3$. Additionally, these materials may be promoted with cocatalysts that are proton releasing substances, e.g., hydrogen halides such as hydrogen chloride and hydrogen fluoride. Since eastern and western American sub-bituminous coals, bituminous coals, and lignite contain significant amounts (as much as 7% by weight) of clays and acidic oxides, the use of clays and acidic oxides either by promotion with acids (e.g., HCl, HF) or alone is particularly preferred. (5) Cation exchange resins. (6) Metathetic cation forming agents. Preferred catalysts are Lewis acids, Bronsted acids and acidic oxides. These catalysts may be mixed together in the presence or absence of a liquid diluent. The components may be mixed separately or in the presence of the substrate coal. Generally, the order of mixing of the reaction components is not critical, but in the case of alkene alkylation the unsaturated moiety should be added in such a way as to minimize polymerization and other side reactions.

When the metal halides are employed normal precautions should be taken to avoid preferential reaction and consequently catalyst deactivation, by combination with water. Thus, the coal is normally dried and should be substantially moisture free, that is, less than 4 wt. % moisture, based on coal, preferably less than 2 wt. % moisture. Alternatively, the acyl halide or alkyl halide can be mixed with the metal halide catalyst prior to contacting with the coal and thereby inhibit any deactivation of the metal halide catalyst due to reaction with water.

The metal halide catalyst must be present in greater than stoichiometric amounts, based on the acylating agent. Thus, about 100 to 150 mol. % metal halide, preferably 100 to 120 mol. %, and more preferably 100 to 105 mol. % metal halide can be employed.

Acylation conditions are not critical and temperatures may range from about −20° to 200° C, preferably 0 to 150° C, while pressures may range from 0 to 2000 psig, preferably atmospheric to 1500 psig. Contact times may also vary widely, e.g., a few seconds to several days, preferably about 10 seconds to 300 minutes, most preferably 1 minute to 2 hours.

Alkylation is similarly accomplished by the use of known techniques. Thus, alkylation of the coal can be effected either with or without the addition of an extraneous catalyst. Normally, alkylation is effected either catalytically or thermally. However, in the case of coal, it is believed that the mineral matter present in coal may also act as a catalyst for alkylation.

Again, moisture should be avoided and the presence of water should be kept below the amounts mentioned above. Additionally, when olefins are employed, care should be taken to avoid conditions that could lead to olefin polymerization, e.g., lower temperatures. Preferably $C_2$ and terminal olefins are used and preferred catalysts are HF, $BF_3$, phosphoric acid, or acid promoted coal mineral matter or no extraneous catalyst. Generally, however, temperatures may range from about 0° to 300° C, preferably 25° to 250° C with pressures ranging from about 0 to 2000 psig, preferably 0 to 1500 psig and contact times again ranging from a few seconds to several days, preferably about 10 seconds to about 300 minutes, most preferably 1 minute to 2 hours. When no extraneous catalyst is employed, temperatures should be raised within the ranges shown to facilitate the process.

A variety of alkylation catalysts can be employed and these can be known and reported catalysts such as the Friedel-Crafts catalysts mentioned above, particularly the Lewis acids, or strong acids such as hydrofluoric acid, hydrochloric acid, sulfuric acid, fluorosulfuric acid, trifluoracetic acid, methane sulfonic acid, and the like as well as mixtures of Lewis acids with Bronsted acids for example as shown in the U.S. Pat. No. 3,708,583. The amount of catalyst, if any, employed can range from 0.05 to 50 wt. % based on coal, preferably 0.05 to 10 wt. %.

The substitution reactions may be carried out in the presence of an inert diluent. Such diluents suitable for use in the process are solvents such as normal paraffins, preferably $C_2$ to $C_{12}$, halogenated solvents such as carbon tetrachloride, chloroform, ethylene dichloride, and other typical Friedel-Crafts alkylation solvents including nitromethane, nitrobenzene, carbon disulfide, etc.

Solvents which may be used to extract the activated coal product, when such extraction is desired, are solvents such as aromatics including benzene, toluene, xylene; paraffins, preferably $C_4$ to $C_{12}$, alcohols, ethers such as ethyl ether, tetrahydrofuran, halogenated solvents such as $CCl_4$, $CHCL_3$, ethylene dichloride, amines such as pyridine quinoline, morpholine, piperidine, etc. and phenols such as phenol, cresol, xylenols, etc., and acetones such as acetone, 2-butanone, etc.

At the conclusion of the alkylation or acylation reaction, the activated coal is separated from the reaction mixture by conventional techniques and made free of any acid catalyst, as by washing. As mentioned above, the alkylation or acylation step can then be repeated to maximize the amount of reagent taken up by the coal and further reduce, insofar as possible, the presence of secondary structural characteristics in the coal.

Generally, any type of higher rank coal can be utilized in the process of this invention, such as bituminous, anthracite, etc., preferably bituminous, the coal is generally ground to a finely divided state and will contain particles less than about ¼ inch in size, preferably less than about 8 mesh, more preferably less than about 100 mesh. It is believed that the degree of alkylation and/or acylation of the coal may be a function of coal surface area. Consequently, it is desirable to expose as much coal surface area as possible without losing coal as dust or fines or as the economics of coal grinding may dictate. Thus, particle sizes of less than about 8 mesh to greater than about 325 mesh are preferred and particle sizes of less than about 100 mesh to greater than about 325 mesh are more preferred. The coal can be dried by conventional drying techniques, for example, by heating to about 100° to 110° C, but below temperatures that might cause other reactions when susceptible coals are employed. The dried coal can then be fed to the alkylation or acylation zone either as a solid or slurried in a suitable solvent, e.g., paraffins such as heptane, hexane, cyclohexane, carbon disulfide, halogenated paraffins such as carbon tetrachloride, $CHCl_3$, etc., although a solid feed is preferred since solvents tend to reduce the activity of catalysts employed in alkylation or acylation.

Subsequent to the alkylation/acylation reaction, the product, hereafter referred to as "activated coal," is subjected to gasification.

Examples 1–3 are presented to demonstrate that the materials used to alkylate coal, when used separately effect essentially no change in the coal and cannot therefore, be viewed as contributing independently to the result finally observed when used in combination.

EXAMPLE 1

EXTRACTION OF RAW ILLINOIS #6 COAL WITH BENZENE

Reactants 30.0 g Illinois #6 (<200 Mesh) refluxed in 500 ml benzene under nitrogen.

Reaction Conditions

T, ° C 78
Pressure, (kPa) 101 (1 atm)
Time, hr 8
Extract Yield = 0.4 g
Recovered Coal = 29.0 g $$\text{Material Balance} = \frac{29.0\text{ g} + 0.4\text{ g}}{30.0\text{ g}} \times 100\% = 98\%$$

$$\%\text{ Extract} = \frac{\text{Extract - Ash Extract}}{\text{Coal - Ash Coal}} \times 100 = 1.5\%$$

| Coal | Recovered Coal |
|---|---|
| % H 5.08 | 4.69 |
| % C 69.07 | 65.86 |
| H/C 0.876 | 0.849 |

EXAMPLE 2

REACTION OF ILLINOIS #6 WITH ALUMINUM CHLORIDE

REACTANTS 10.0 g Illinois #6 (<200 Mesh) added to 3.0 g $AlCl_3$ in a 120 ml Paar autoclave at 25° C.

Reaction Conditions

T, ° C 140
Pressure, Total (kPa), 25° C 276 40 psi
Time, hr 24
Mixture quenched, filtered and vacuum oven dried 12 hr at 80° C.
Recovered Coal = 9.5 g $$\text{Material Balance} = \frac{9.5\text{ g}}{10.0\text{ g}} \times 100\% = 95\%$$

Recovered Coal
Benzene Extraction

| Before Extraction | After Extraction |
|---|---|
| % H 4.59 | 4.65 |
| % C 66.60 | 66.23 |

-continued

| REACTION OF ILLINOIS #6 WITH ALUMINUM CHLORIDE | |
|---|---|
| H/C 0.821 | 0.837 |

EXAMPLE 3

| EFFECT OF 2-CHLOROPROPANE ON COAL |
|---|

Reactants 2.0 g Illinois #6 (<200 mesh) covered in a capped jar with 2-chloropropane.

Reaction Conditions

T, ° C 25 25
Pressure, kPa 101.353
Time, Hr 12
Mixture washed with water, separated by filtration and the coal vacuum oven dried for 16 hrs. at 80° C.

| Treated Coal |
|---|
| % H 4.61 |
| % C 66.47 |
| H/C 0.826 |
| No Reaction Observed. |

GENERAL PROCEDURE - ALKYLATION

A 128 ml Paar autoclave (316 stainless steel) is charged with vacuum-oven dried coal, alkylating agent and catalyst at either 0° or room temperature. If either or both the alkylating agent and catalyst are gases, the gaseous reactant(s) is added last to the evacuated autoclave. When a reaction temperature above room temperature was required, the heat was supplied by an external steam bath or by an oil bath. All reactions were cooled to ambient prior to venting or collecting the gases and opening the autoclave. The solid reaction product is treated with enough water or dilute caustic to destroy the strong Lewis acid catalyst and the aqueous material is separated either by filtration or extraction with a suitable organic solvent.

EXAMPLE 4

To demonstrate the results obtained by realkylation of the coal (i.e. multiple alkylation).

Reactants 28.13 g <100 mesh Illinois #6, 41.6 g, 2-chloropropane, 5.9 g aluminum chloride in a 128-ml Paar autoclave.

Reaction Conditions

| | | | |
|---|---|---|---|
| T, ° C | Initial | 0 | |
| | Maximum | 100 | |
| Pressure, MPa, | Maximum | 2.90 | 420 psig |
| | Final | 1.86 | 270 psig |
| Time | Hr | 1.7 | |

Vessel vented, the reaction mixture quenched with 20 ml water, filtered, and the coal product taken up in 300 ml benzene.

Extraction 0.17 hr in hot (75° C) benzene gave 3.46 g extract $$\% \text{ Extract} = \frac{3.46 \text{ g} \times 100\%}{28.13 \text{ g} - 2.81 \text{ g (ASH)}} = 13.7\%$$

Realkylation

Recovered coal (30.26 g), 59 g 2-chloropropane and 6.0 g aluminum chloride in a 128 ml Paar autoclave.

Reaction Conditions

T, ° C 160
Pressure, MPa, Max 340 psig
Pressure, Final 80 psig
Time, Hr 12
Vessel vented, quench filtered, and extracted with pentane (0.10 g), cold benzene and hot (75° C) benzene (1.52 g). Solid recovered was 30.48 g.
Total Extract = 5.1 g -continued $$\% \text{ Extract} = \frac{5.1}{(28.1 - 2.81)} \times 100\% = 20\%$$

Analyses

| | Coal | Product | Extract |
|---|---|---|---|
| % H | 5.29 | 4.88 | 8.65 |
| % C | 68.58 | 58.04 | 86.32 |
| H/C | 0.926 | 1.01 | 1.20 |
| % Cl | 0.18 | 6.20 | — |
| % N | 1.35 | 0.93 | 0.092 |
| % STotal | 4.01 | 2.80 | 0.28 |
| % Spyritic | 1.12 | — | — |
| % Ash | 8.20 | 13.0 | — |
| % O | — | — | 2.0 |
| Mol. Wt. | | | 280.0 (GPC, Hydrocarbon Standard) |

ALKYLATION WITH OLEFINS-GENERAL

In general the chief difference between alkyl halide and olefin alkylations are: the olefins used are gaseous and side reactions and especially polymerizations are far more prevalent with olefin alkylations.

When an olefin polymerizes the product has the molecular formula $(CH_2)_n$. In those alkylations where a liquid product or liquid extract has an H/C atomic ratio of 1.9→2.0 we consider this product to be essentially polymeric olefin with some small amount of coal possibly dissolved in the polymer.

EXAMPLE 5

| ALKYLATIONS WITH ETHYLENE |
|---|

Reactants 10.0 g Illinois #6 (<200 Mesh), 0.758 Mpa (110 psi) HCl, 0.793 MPa (115 psi) ethylene.

Reaction Conditions

T, ° C 100
Pressure, MPa 2.65 385 psi
Time, Hr 2
Vessel vented, product water washed and dried overnight at 80° C on house vacuum.
No extraction run.

| Analyses on Product | |
|---|---|
| % H | 4.69 |
| % C | 65.98 |
| H/C | 0.854 |
| % ASH | 9.38 |

EXAMPLE 6

Alkylated Illinois coal vs. raw Illinois coal gives improved volatile matter make and improved carbon dioxide gasification rate. There is no change in steam gasification rate.

REACTANTS 10.0g Illinois #6 (< 100 mesh), 3.0g aluminum chloride and 10.0g of 2-chloropropane were mixed together at 0° C in a 128 cc autoclave which was then sealed at 0° C.

| REACTION CONDITIONS | | |
|---|---|---|
| T, ° C | 155 | |
| Pressure (Kpa) | 2275 | 827 at 25° |
| Time, Hr. | 1 | |

Mixture was cooled to room temperature, the autoclave was vented and the reaction products were water washed, filtered and vacuum oven dried to give 11.73 g of product: 69.04% C, 6.17% H, H/C = 1.06.

EXAMPLE 7

Alkylated Kentucky HVB coal vs. raw Kentucky HVB coal gives improved volatile matter make and improved carbon dioxide gasification rate. There is no change in steam gasification rate.

REACTANTS 10.0g Kentucky HVB (dry, <100 mesh) 2g aluminum chloride and 8.6g of 2-chloropropane were mixed together at 0° C in a 365 cc autoclave which was then sealed at 0° C.

| REACTION CONDITIONS: | | |
|---|---|---|
| T, ° C | 176 | |
| Pressure (Kpa) | 1896 | 690 at 25° |
| Time, Hr. | 1.5 | |

Mixture was cooled to room temperature, the autoclave was vented and the reaction products were water washed, filtered and vacuum oven dried to give 11.7g of product.

EXAMPLE 8

Alkylated Wyodak coal vs. raw Wyodak coal gives no improvement in volatile matter make and marked decreases in the rate of carbon dioxide and steam gasification vs. the untreated coal.

REACTANTS 20.0g Wyodak (dry, <100 mesh), 5.0g aluminum chloride and 20.0g of 2-chloropropane were mixed together at 0° C in a 128cc autoclave which was then sealed at 0° C.

| REACTION CONDITIONS: | | |
|---|---|---|
| T, ° C | 150 | |
| Pressure (Kpa) | 2551 | 1310 at 25° |
| Time, Hr. | 1 | |

Mixture was cooled to room temperature, the autoclave was vented and the reaction products were water washed, filtered and vacuum oven dried to give 17.0g of product.

EXAMPLE 9

Reactants 5.0 g Illinois #6 coal (<200 Mesh) 1.0 g aluminum chloride, 2.5 ml 1-octadecene and 15 ml carbon tetrachloride charged to autoclave.

Reaction Conditions

| | |
|---|---|
| T,° C | 80 |
| Pressure, MPa | — |
| Time, Hr | ~16 |

Vessel was vented, product filtered, $CCl_4$ layer water washed, dried and evaporated to give 1.8 g extract (A) residue, after washing with dilute HCl, dilute caustic, and water and drying overnight in a vacuum oven at 80° C, was 5.06 g (B).

Analyses

| | B |
|---|---|
| % H | 5.15 |
| % C | 67.98 |
| H/C | 0.908 |

Changes in the reactivity of Illinois #6 Kentucky and Wyodak coals which result from alkylation have been measured.

GASIFICATION

It is difficult to give an all-encompassing and unambiguous definition of reactivity when referring to coal or coke. However, the rate of gasification by $CO_2$ is often taken as a measure of activity and generally as a measure of ease and facility of gasification in general and therefore this approach has been used.

Using a sensitive recording balance, the rates of reaction with carbon dioxide of the alkylated coal sample as a function of burn-off, i.e., of the extent of reaction at 850° C, have been measured. These were then compared with the rates obtained under identical conditions for an untreated sample. Extracted and unextracted alkylated coals were also compared. (See Table II).

These experiments were performed on samples which initially weighed ~ 50 mg. They were heated at a rate of from 5° to 10° C/min to 850° C and maintained at that temperature for 45 min. in an atmosphere of argon flowing through the reactor at a rate of 2 liter/min. This pyrolysis resulted in a substantial loss of weight due to volatilization of easily removed material. In the case of the untreated sample, this loss amounted to 49.7%, the weight decreasing from 50.90 mg to 25.60 mg. The alkylated sample lost an almost identical weight, i.e., 50.9%. When the weight of the sample reached a steady value, the argon atmosphere was replaced by $CO_2$ at 1 atmosphere flowing at the rate of 2 L/min also and the weight loss which occurred as a result of gasification due to the reaction: $C + CO_2 \rightarrow 2\ CO$ was continuously recorded. From these curves both the rates $dm/dt$ and the actual weight of the sample ($m$) could be calculated. In the attached Figures the rate of gasification expressed as $(1/m)\ dm/dt$ against percent burn-off has been plotted.

These experiments resulted in the following conclusions:

1. The amount of volatile materials lost upon pyrolysis is greater for alkylated than nonalkylated coal samples in all reported instances with the exception of Wyodak coal;

2. The rate of gasification increases with increased burn-off. At ~ 80% burn-off, for example, (see FIG. I), the rate is almost 3 times the initial rate of gasification. This acceleration of the gasification process is likely due to an increase in the surface area of the solid and to an enlargement of pore diameters so as to make them more accessible to reaction.

3. The rate of gasification of the alkylated extracted sample is higher than that of the untreated coal. Initially, this increase amounts to about 40–45% although the average increase is probably more like 25%. This improvement is significant.

From this it can be seen that alkylated coal (Illinois #6) whether extracted or not extracted, gasifies more rapidly than does nonalkylated coal. Alkylated Illinois #6 and Kentucky coals exhibit greater weight loss upon pyrolysis (on the order of 25 to 100% increase) as compared to nonalkylated Illinois #6 and Kentucky coals.

The reactivity of alkylated Wyodak coals with that of the corresponding untreated sample have also been compared. As previously indicated, the rate of gasification of the coals by $CO_2$ at 850° C and 1 atm pressure has been taken as a measure of reactivity.

The instantaneous rates increase with burn-off. The rate of gasification of the untreated Wyodak coal is over 10 times faster than that of the alkylated sample. This is in contradistinction with the behavior which we have observed with the Illinois coal which, upon alkylation, had somewhat higher reactivities (40–50% higher) and indicates that all coals are not equivalent insofar as their ability to benefit from electrophilic aromatic substitution pretreatment in the case of gasification. This is more easily seen in the table below.

Untreated Wyodak gasifies 5–10 times faster than does alkylated Illinois. The results of these various experiments are summarized in Table II below.

TABLE II

GASIFICATION WITH $CO_2$ AND $H_2O$ SHOWS ALKYLATION CAN AFFECT THE COAL CHAR*

| Coal Type | Treatment | % Wt. Loss Pyrolysis to 850° C. | % Burn-Off ($CO_2$)** 20 | 40 | 60 | % Wt. Loss Pyrolysis to 850° C | % Burn-Off ($H_2O$)** 20 | 40 | 60 |
|---|---|---|---|---|---|---|---|---|---|
| Wyodak | Alkylated | 52.3 | 3.8 | 4.2 | 4.6 | 54.3 | 52.0 | 53.5 | 55.0 |
| | Raw | 55.3 | 55.0 | 61.0 | 65.0 | 50.4 | 218 | 240 | 270 |
| Illinois | Alkylated | 65.1 | 7.8 | 8.8 | 9.8 | 50.9 | 43.2 | 38.0 | 36.0 |
| | Raw | 50.2 | 5.5 | 6.2 | 7.0 | 41.8 | 39.0 | 40.9 | 36.2 |
| | Alkylated Extracted | 50.9 | 9.9 | 13.0 | 15.7 | | | | |
| | Raw | 49.7 | 7.7 | 10.7 | 13.8 | | | | |
| Kentucky | Alkylated | 43.3 | 5.6 | 5.8 | 5.9 | 42.6 | 37.0 | 39.0 | 30.4 |
| | Raw | 26.6 | 3.4 | 3.3 | 3.3 | 32.5 | 35.5 | 37.7 | 28.8 |

*850° C

**Instantaneous burn-off rate mg/min./g. carbon.

This increase of the gasification rate in the case of alkylated Illinois #6 and Kentucky coals as compared with identical unalkylated coals indicates that the gasification process is beneficially affected by electrophilic aromatic substitution pretreatment of certain coals and results in an improved gasification process which is markedly superior to standard gasification processes utilizing unpretreated coals. The increased weight loss upon slow pyrolysis of the alkylated coals coupled with the enhanced rate of gasification of the pretreated coals demonstrate that the coal is being more efficiently utilized on a per ton basis by pretreating the coal with an electrophilic aromatic substitution step and consequently results in production of an increased volume of desired end products as compared with identical pyrolysis-gasification techniques practiced on unpretreated coal.

In general, the gasification procedures practical in the instant invention utilizing the superior characteristics of electrophilically substituted coal may include procedures wherein the small molecule gas used to gasify mau be $CO_2$, $H_2O$ (steam), $H_2$, air, $O_2$, CO, $H_2S$, $SO_2$, $NH_3$ or mixtures thereof, especially $H_2O/H_2$.

The gasification procedures which may be practiced using the above small molecule gases may be run at pressures ranging from atmospheric to 2000 psi, preferably 50 psi to 500 psi. The temperatures at which such procedures may be run range from 200° to 1200° C, preferably 425° to 900° C. The electrophilically aromatically substituted coal is heated to the desired maximum temperature (from the starting point of ambient room temperature) at a rate of from 0.1° C/min to 10° C/min. The heating rate is selected in order to alter aspects of the pyrolysis process other than the total weight loss such as for example, the fluidity of the coal, gas versus liquid make, heat transfer limitation, etc. Once the electrophilically aromatically substituted coal is heated to the desired maximum temperature, it may be held at that temperature for a period of time ranging anywhere from 1 minute to two hours, preferably 1 min. to 1 hour, most preferably 1 min. to 30 min.

What is claimed is:

1. A process for the gasification of coal which comprises:

(1) treating the coal with a reagent selected from the group consisting of alkylating agents and acylating agents and thereby introducing into the coal a radical selected from the group consisting of aliphatic hydrocarbon radicals and acyl radicals respectively to yield a treated coal;

(2) subjecting the treated coal to gasification conditions.

2. The process of claim 1 wherein the gasification reaction practiced on the treated coal comprises using materials selected from the group consisting of $CO_2$, $H_2O$, steam, $H_2$, air, $O_2$, CO, $H_2S$, $SO_2$, $NH_3$ and mixtures thereof at pressures ranging from atmospheric to 2000 psi and at temperatures ranging from about 300° to about 1000° C.

3. The process of claim 1 wherein the reagent is an alkylating agent and is selected from the group consisting of olefins, paraffins, organo halides, wherein the organo group is an alkyl, cycloalkyl, arylcycloalkyl or aryl alkyl radical, the halogen is selected from the group consisting of fluorine, chlorine, bromine and iodine, and organo hydroxyls wherein the organo group is as defined previously.

4. The process of claim 1 wherein the reagent is an acylating agent and is selected from the group consisting of CO, haloacyls and compounds having the formula

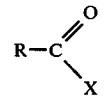

wherein R is an alkyl, cycloalkyl, arylcycloalkyl or aryl alkyl radical and X is a halogen or anhydride derivative.

5. The process of claim 1 wherein the treating step of step (1) practiced on the coal further comprises the use of a catalyst.

6. The process of claim 4 wherein the acylation step is practiced on coal using carbon monoxide as the acylating agent in the presence of a hydrogen halide catalyst.

7. The process of claim 1 wherein step (1) comprises treating the coal under appropriate conditions to an alkylation reagent selected from the group consisting of organo halides and organo hydroxyls, wherein the organo group is selected from the group consisting of $C_2$–$C_{20}$ alkyl, cycloalkyl, arylcycloalkyl and aryl alkyl radical and halogen is selected from the group consisting of chlorine and bromine in the presence of a catalyst.

8. The process of claim 5 wherein the catalyst is selected from the group consisting of Lewis acids.

9. The process of claim 8 wherein the Lewis acid catalyst is selected from the group consisting of aluminum chloride, aluminum bromide, zinc chloride, ferric chloride, boron trifluoride.

10. The process of claim 1 wherein step (1) practiced on the coal comprises:

(1) treating the coal with a reagent selected from the group consisting of alkylating agents and acylating agents at a pressure and for a time sufficient to cause the coal to react with the reagent;

(2) working the treated coal to remove substantially all of the unreacted reagents;

(3) repeating steps (1) and (2).

11. The process of claim 1 step (1) wherein the coal being treated is a higher rank coal.

12. The process of claim 11 wherein the coal is selected from the group consisting of bituminous and anthracite.

13. The process of claim 11 wherein the coal is selected from the group consisting of Illinois #6 and Kentucky HVB coals.

14. The process of claim 1 wherein the alkylating agent is a $C_2$–$C_8$ alkyl halide.

15. The process of claim 1 wherein the alkylating agent is a $C_2$–$C_8$ olefin.

16. The process of claim 1 wherein the acylating agent is a $C_2$–$C_{20}$ acyl halide.

17. The process of claim 1 further characterized by the step of extracting the treated coal of step (1) with a solvent before subjecting it to gasification conditions.

18. The process of claim 17 wherein the solvent of the extraction step is selected from the group consisting of benzene, toluene, xylene, paraffins, alcohols, ethers, hydrocarbon halides, amines, phenols and ketones.

19. The process of claim 1 further characterized by the step of slowly pyrolyzing the treated coal of step 1 resulting in a volatile product make and a char make and subjecting the char make to the gasification conditions of step (2).

20. The process of claim 19 wherein the slow pyrolysis step comprises heating the treated coal at a rate of from 0.1° C/min to 10° C/min to a temperature of from 200° to 1200° C in a flowing inert gas atmosphere.

21. The process of claim 3 wherein the alkylation step practiced on the coal further comprises the use of a catalyst.

22. The process of claim 4 wherein the acylation step practiced on the coal further comprises the use of a catalyst.

23. The process of claim 21 wherein the catalyst is selected from the group consisting of Lewis acids.

24. The process of claim 23 wherein the Lewis acid catalyst is selected from the group consisting of aluminum chloride, aluminum bromide, zinc chloride, ferris chloride, and boron trifluoride.

25. The process of claim 22 wherein the catalyst is a hydrogen halide.

26. The process of claim 7 wherein the catalyst is selected from the group consisting of Lewis acids.

* * * * *